US007201348B1

(12) United States Patent
Flammer

(10) Patent No.: US 7,201,348 B1
(45) Date of Patent: Apr. 10, 2007

(54) CRUISE MISSILE RECOVERY SYSTEM

(75) Inventor: Mark S. Flammer, Boulder Creek, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 318 days.

(21) Appl. No.: 11/037,771

(22) Filed: Jan. 19, 2005

(51) Int. Cl.
*B64D 5/00* (2006.01)
*B64D 17/80* (2006.01)
*B64C 31/00* (2006.01)

(52) U.S. Cl. ..... 244/110 C; 244/139; 244/152

(58) Field of Classification Search ..... 244/2, 244/30, 31, 32, 110 C, 110 F, 139, 142, 152
See application file for complete search history.

(56) References Cited

U.S. PATENT DOCUMENTS 1,716,670 A * 6/1929 Sperry ..... 244/2
2,365,778 A * 12/1944 Schwab ..... 89/1.11
3,389,880 A * 6/1968 Ferguson ..... 244/137.1
4,102,519 A 7/1978 Crosby, Jr. ..... 244/125
4,995,572 A * 2/1991 Piasecki ..... 244/2
5,297,759 A 3/1994 Tilbor et al. ..... 244/17.11
5,583,311 A 12/1996 Rieger ..... 89/1.11
5,893,536 A 4/1999 Lee et al. ..... 244/149
5,947,420 A 9/1999 Backman ..... 244/155 R
6,116,606 A 9/2000 Brum ..... 273/360
6,220,547 B1 * 4/2001 Smith et al. ..... 244/147
6,587,762 B1 7/2003 Rooney ..... 701/16

* cited by examiner

*Primary Examiner*—Robert P. Swiatek
(74) *Attorney, Agent, or Firm*—John Tarlano

(57) ABSTRACT

A cruise missile recovery system, for capturing a flying cruise missile and for guiding the cruise missile to a landing spot. The cruise missile recovery system has an intercept device for capturing the flying cruise missile, a radio-controlled parafoil connected to the intercept device for allowing the intercept device and cruise missile to be guided to the landing spot during descent of the intercept device and cruise missile, after capture of the flying cruise missile by the intercept device, and a position-stabilized suspension vehicle for suspending the radio-controlled parafoil device and the intercept device at a stable location above the earth, prior to capture of the flying cruise missile by the intercept device.

3 Claims, 4 Drawing Sheets

CRUISE MISSILE RECOVERY SYSTEM

BACKGROUND OF THE INVENTION

In U.S. Pat. No. 5,583,511, an intercept device is used for snagging a flying vehicle. The purpose of the intercept device is to hinder further flight of the flying vehicle, such as a jet aircraft.

The '511 patent shows that the intercept device can be connected to drag producing devices, such as parachutes. The parachutes decrease speed of descent of the intercepted vehicle. However, the parachutes cannot be guided to a location on the earth.

In the '511 patent, the intercept device is deployed from a missile. The missile is flown in front of the flying vehicle. The intercept device is then deployed by means of the missile. The flight path of the missile intersecting the flight path of the flying vehicle. The intercept device intersects the flight path of the flying vehicle.

The present invention is a cruise missile recovery system for capturing a flying cruise missile, and for guiding the cruise missile to a landing spot. The recovery system includes a position-stabilized suspension vehicle, a radio-controlled parafoil and an intercept device. The position stabilized suspension vehicle is connected to the radio-controlled parafoil. The radio-controlled parafoil is connected the intercept device. A drogue parachute is also connected to the radio-controlled parafoil. A homing beacon is attached to the intercept device. The cruise missile recovery system is stably positioned above a point on earth.

The position-stabilized suspension vehicle suspends the radio-controlled parafoil and the intercept device, stably, above a point on the earth. The test-type cruise missile homes in on the homing beacon that is located on the intercept device of the recovery system. The cruise missile is captured by the intercept device.

Such a position-stabilized suspension vehicle includes a position-stabilized helicopter, position-stabilized dirigible or position-stabilized balloon. The position-stabilized suspension vehicle suspends the radio-controlled parafoil and the intercept device, stably, at a location above a point on the earth. The A homing beacon is connected onto the intercept device. The cruise missile homes in on the homing beacon that is on the intercept device. The cruise missile has hooks. The hooks snag netting of the intercept device.

The cruise missile is flown into the intercept device. The intercept device captures the cruise missile by means of the hooks that are attached to the cruise missile. The impact of the cruise missile with the intercept device pulls the intercept device and the radio-controlled parafoil away from the suspension vehicle. The parafoil completely opens as it descends to earth, after the parafoil is pulled away from the suspension vehicle. The parafoil allows the cruise missile to slowly descend toward the earth. The radio-controlled parafoil guides the cruise missile safely guided to earth. After the test-type cruise missile safely lands, the test-type cruise missile can be reloaded with rocket fuel and used again.

The parafoil is radio-controlled. The aerodynamic properties of the parafoil can be controlled be a radio transmitter, such as a radio transmitter in a plane, on a ship or on the earth. As a cruise missile descends toward the earth, the parafoil can be guided toward a landing spot on the earth, by means of the radio transmitter. The landing spot could be a landing spot on a ship, or a landing spot on land.

SUMMARY OF THE INVENTION

A cruise missile recovery system for capturing a flying cruise missile and for guiding the cruise missile to a landing spot comprising an intercept device for capturing the flying cruise missile; a radio-controlled parafoil connected to the intercept device for allowing the intercept device and cruise missile to be guided to the landing spot during descent of the intercept device and cruise missile, after capture of the flying cruise missile by the intercept device; and a position-stabilized suspension vehicle for suspending the radio-controlled parafoil device and the intercept device at a stable location above the earth, prior to capture of the flying cruise missile by the intercept device.

DESCRIPTION OF PREFERRED EMBODIMENTS

Figure 1A:
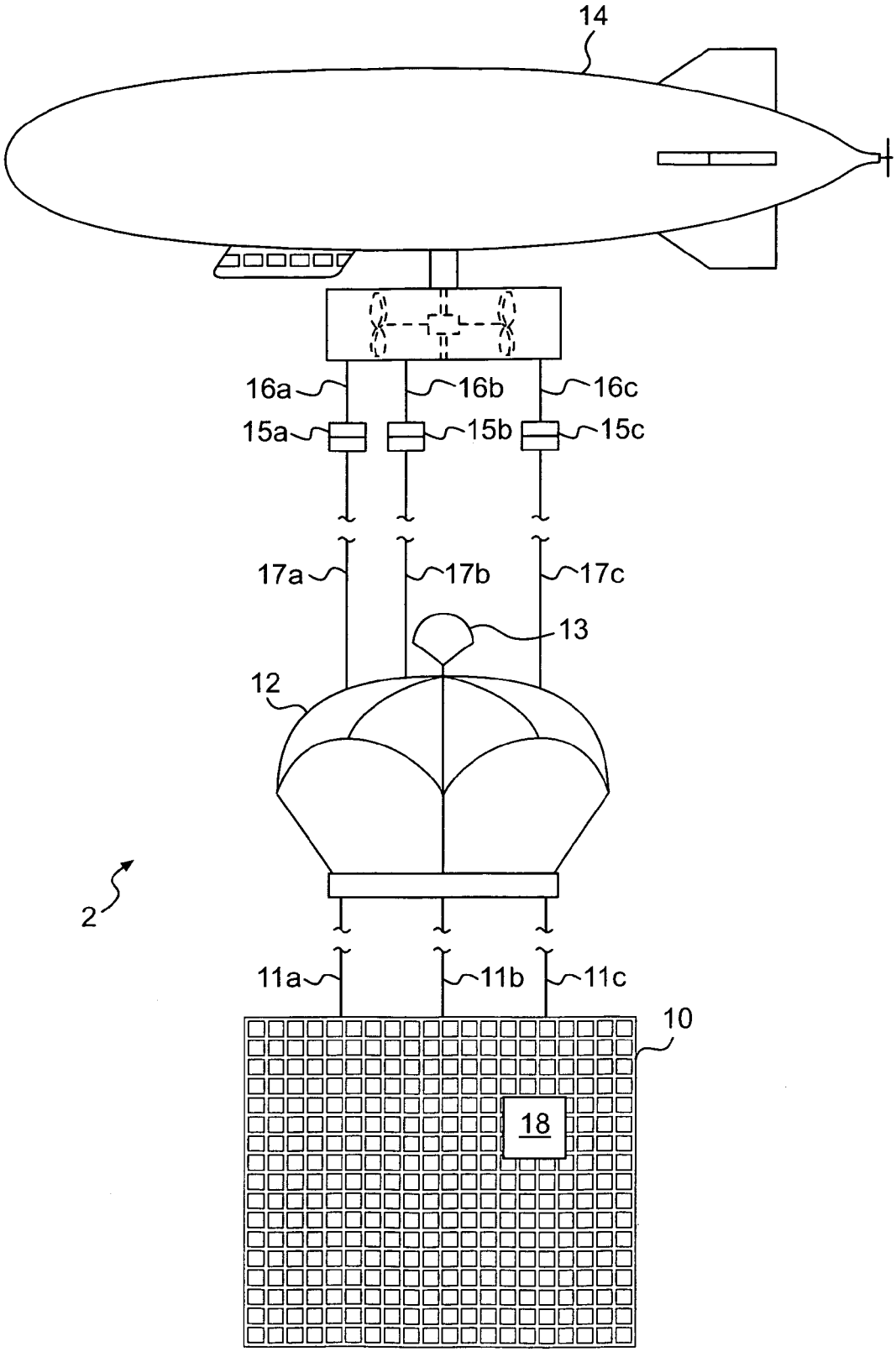
FIG. 1A is a plan view of an embodiment of a cruise missile recovery system that is positioned at a stable location above a point on the earth.

FIG. 1A is an embodiment of a cruise missile recovery system, cruise missile recovery system 2. The cruise missile recovery system 2 uses a net 10 to capture a test-type cruise missile. The net 10 is an intercept device. The net 10 is connected to cable 11*a*, 11*b* and 11*c*. The cables 11*a*, 11*b* and 11*c*, in turn, are connected to a radio-controlled parafoil 12. A drogue parachute 13 is also connected to the radio-controlled parafoil 12.

In FIG. 1A, a position-stabilized dirigible 14 suspends the parafoil 12 and the net 10 at a stable location above a point on the earth. The position-stabilized dirigible 14 is a position-stabilized suspension device. The position-stabilized dirigible 14 is connected to tension release couplings 15*a*, 15*b* and 15*c*. The tension release couplings 15 *a*, 15*b* and 15*c* are connected to parafoil 12. The parafoil 12 is connected to the dirigible 14 by means of the tension release couplings 15*a*, 15*b* and 15*c*, cables 16*a*, 16*b*, 16*c* and cables 17*a*, 17*b* and 17*c*. A homing beacon 18 is attached to net 10. The cables 17*a*, 17*b* and 17*c* have a sufficient length so that an incoming cruise missile will not hit, or aerodynamically upset, the position-stabilized dirigible 14.

The radio-controlled parafoil 12 is fully opened after it is pulled away from the dirigible 14. The parafoil 12 is pulled away from the dirigible 14 by an impact to the net 10 by a cruise missile. The radio-controlled parafoil 12 allows the cruise missile to slowly descend. The radio-controlled parafoil 12 guides the cruise missile to a landing spot on land or on sea.

Figure 1B:
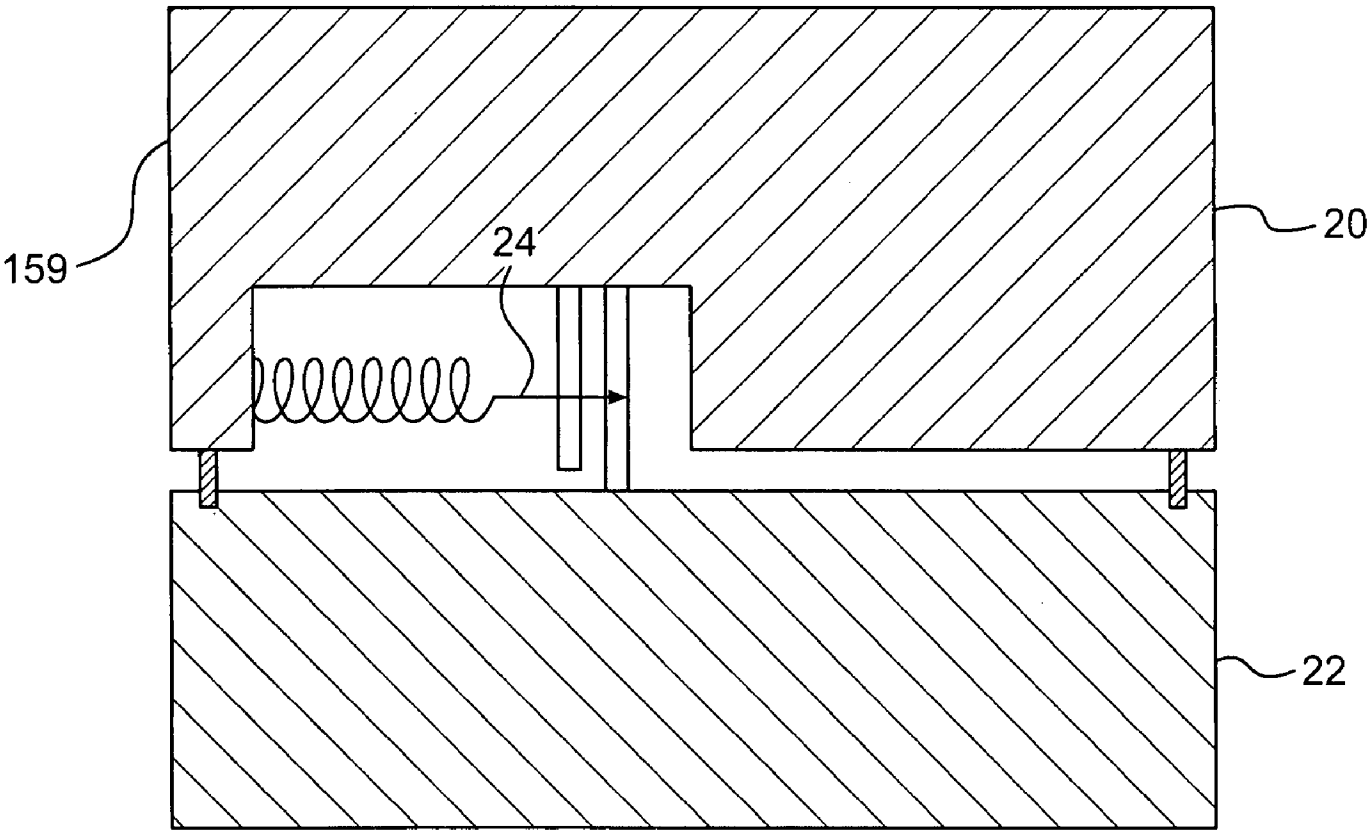
FIG. 1B is a sectional view of a break-away coupling.

Each of the tension release couplings 15*a*, 15*b* and 15*c* has a first half and a second half. For instance, tension release coupling 15*a*, shown in FIG. 1B, has a first half 20 and a second half 22. The first half 20 and second half 22 are connected together by a spring loaded connector 24, shown in FIG. 1B. The spring loaded connector 24 allows the first half 20 and the second half 22 to be separated from each other when tension of a selected amount is applied to the second half 22, due to impact of a cruise missile on the net 10.

Figure 2:
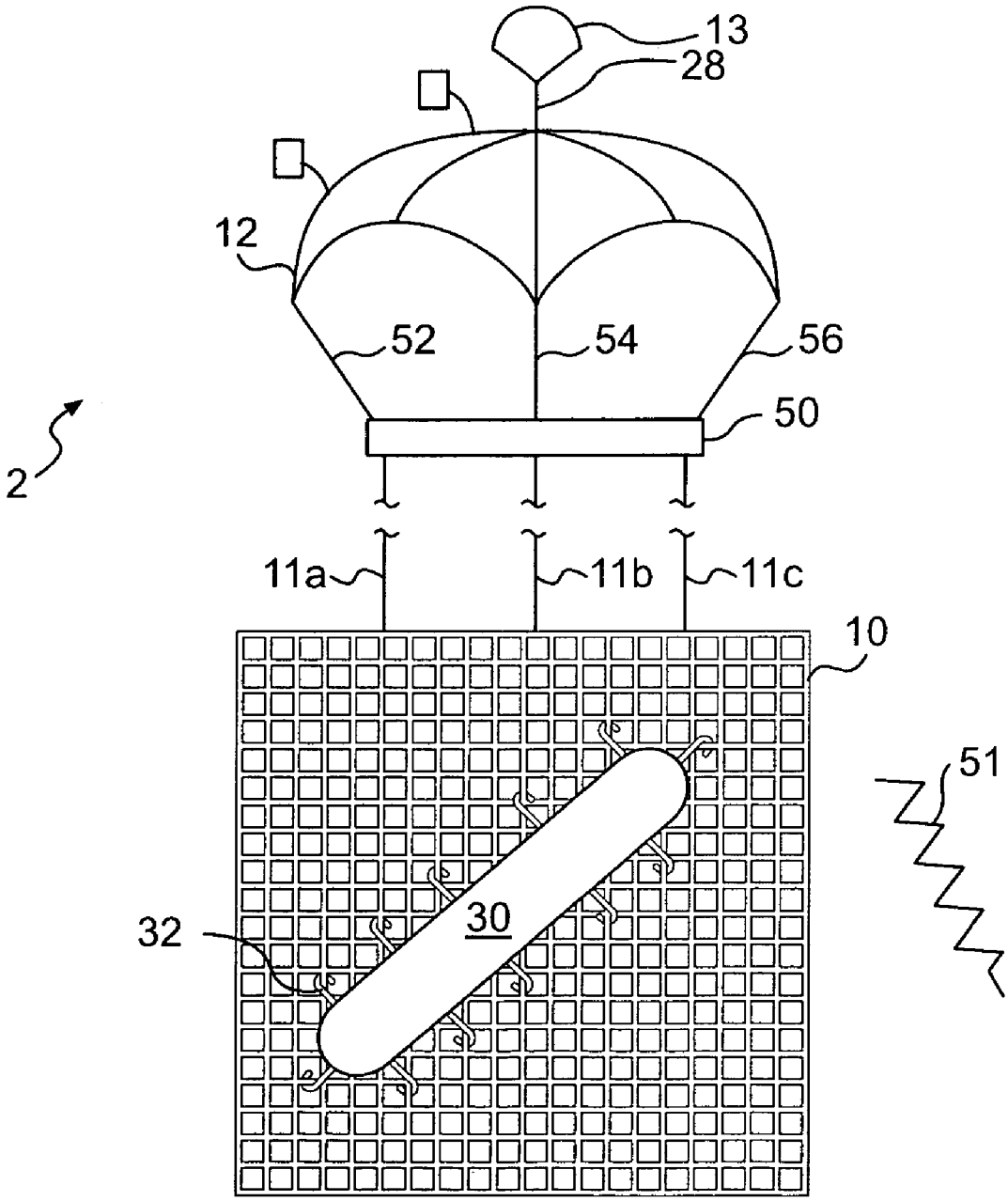
FIG. 2 is a plan view of parts of a cruise missile recovery systems and a cruise missile, after capture of the cruise missile, the cruise missile being guided to a landing spot.

As shown in FIG. 2, a cruise missile 30 has homed in on a homing beacon 18 that is attached to net 10. The cruse missile 30 has impacted the net 10 and has been captured by the net 10. Hooks 32, located on the cruise missile 30, take hold onto the net 10. The parafoil 12 has separated from the dirigible 14, due to, an impact of cruise missile 30 with the net 10, as shown in FIG. 2. The drogue parachute 13 is attached to the parafoil 12. The parafoil 12 is shown as having been deployed. The drogue parachute 13 aids in bellowing out parafoil 12. The parafoil 12 is changed from a partially folded state into an unfolded state with the aid of drogue parachute 13. Drogue parachute 13 is opened by the pull of rushing air. Drogue parachute 13 is connected to parafoil 12 by means of cord 28.

The parafoil 12 allows the missile 30 to slowly descend toward the surface of the earth. The radio-controlled parafoil 12 guides the cruise missile 30 to a landing spot. The cruise missile 30 will land at a selected landing spot on the surface of the earth, without being damaged. Thus the cruise missile recovery system 2 is able to capture the cruise missile 30 and guide it down.

The parafoil 12 is radio controlled by means of a radio signal 51 that is sent to a parafoil controller 50. Chute lines 52, 54 and 56 of parafoil 12 are selectively reeled in or out by parafoil controller 50. The parafoil controller 50 thus controls a flight path of the parafoil 12. The radio-controlled parafoil 12 is guided toward the landing spot on the surface of the earth by mean of a radio signal to the controller 50. Again, parafoil controller 50 controls the flight of parafoil 12. The radio signal can be transmitted from a ship, from a ground location or from an airplane. The parafoil 12 flies toward the landing spot, as the parafoil 12 is being radio controlled through parafoil controller 50.

Figure 3:
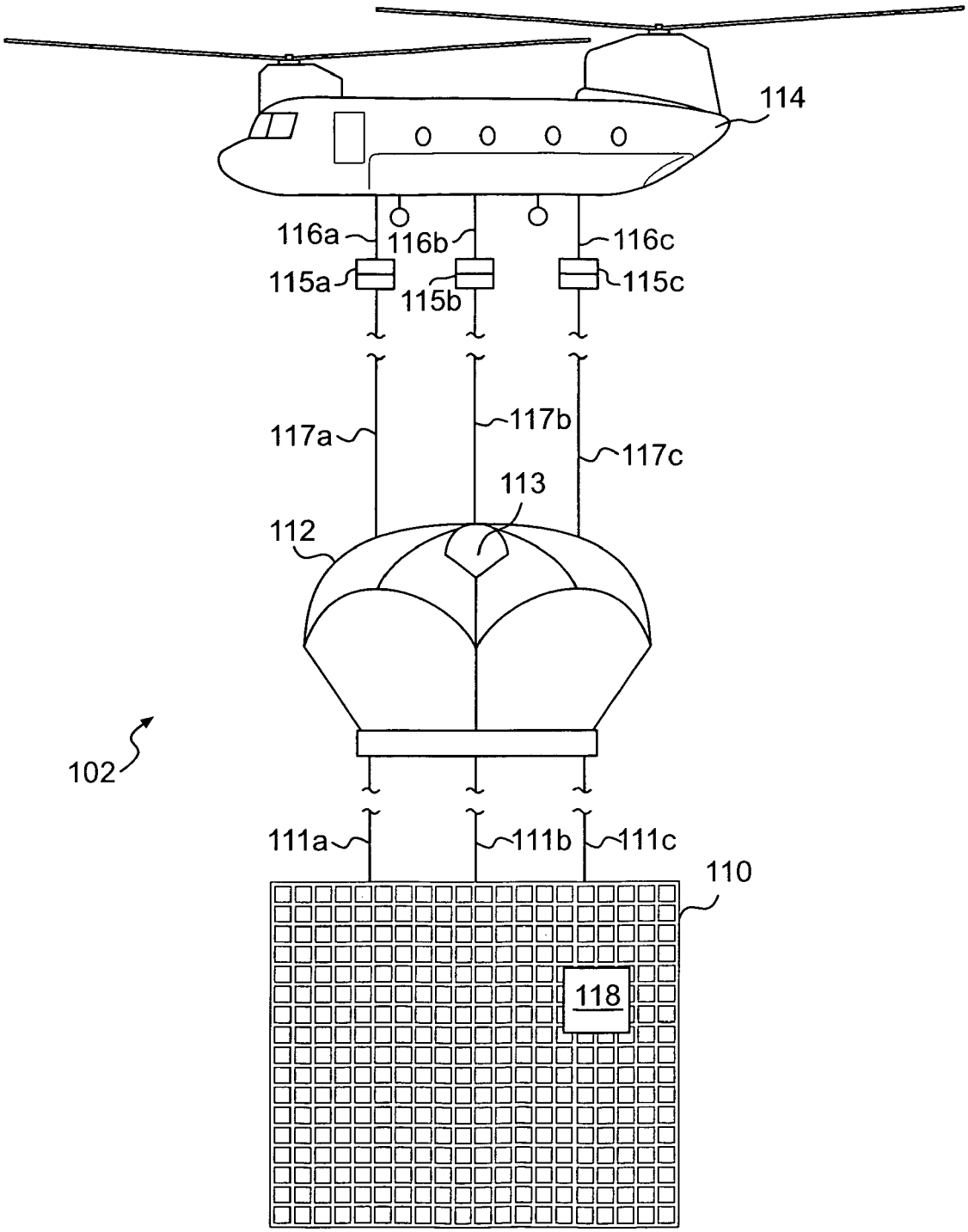
FIG. 3 is a plan view of another embodiment of a cruise missile recovery system that is positioned at a stable location above a point on the earth.

FIG. 3 shows another embodiment of a cruise missile recovery system, cruise missile recovery system 102. The cruise missile recovery system 102 has a net 110. The net 110 is used as an intercept device, to capture a cruise missile. The net 110 is connected to cable 111*a*, 111*b* and 111*c*, the cables 111*a*,111*b* and 111*c*, in turn, being connected to a parafoil 112. A drogue parachute 113 is connected to a cord on parafoil 112.

In FIG. 3, a position-stabilized helicopter 114 is connected to break-away couplings 115*a*, 115*b* and 115*c*. The breakaway couplings 115 *a*, 115 *b* and 115*c* are connected to parafoil 112. The parafoil 112 is connected to the helicopter 114 by means of the break-away couplings 115*a*, 115*b* and 115*c*, cables 116*a*, 116*b*, 116*c* and cables 117*a*, 117*b* and 117*c*. A homing beacon 118 is attached to net 110. The cables 117*a*, 117*b* and 117*c* have a sufficient length so that an incoming cruise missile will not hit, or aerodynamically upset, the position-stabilized helicopter 114.

The position-stabilized helicopter 114 suspends the parafoil 112, the net 110, and the drogue parachute 113 at a stable location above a point on the earth.

Each of the couplings 115*a*, 115*b* and 115*c* has a first half and a second half. The first half and the second half are connected together by a spring loaded connector. The spring loaded connector allows the first half and the second half to be separated from each other when tension of a selected amount is applied to the second half, due to impact of a cruise missile on the net 110.

While the present invention has been disclosed in connection with the preferred embodiment thereof, it should be understood that there may be other embodiments which fall within the spirit and scope of the invention as defined by the following claims.

What is claimed is:

1. A cruise missile recovery system for capturing a flying cruise missile and for guiding the cruise missile to a landing spot, comprising:

(a) an intercept device for capturing the flying cruise missile;

(b) a radio-controlled parafoil connected to the intercept device for allowing the intercept device and cruise missile to be guided to the landing spot during descent of the intercept device and cruise missile, after capture of the flying cruise missile by the intercept device; and (c) a position-stabilized suspension vehicle for suspending the radio-controlled parafoil and the intercept device at a stable location above the earth, prior to capture of the flying cruise missile by the intercept device.

2. A cruise missile recovery system for capturing a flying cruise missile and for guiding the cruise missile to a landing spot, comprising:

(a) an intercept device for capturing the flying cruise missile;

(b) a radio-controlled parafoil connected to the intercept device for allowing the intercept device and cruise missile to be guided to the landing spot during descent of the intercept device and cruise missile, after capture of the cruise missile by the intercept device;

(c) a drogue parachute connected to the radio-controlled parafoil for aiding in deployment of the radio-controlled parafoil; and (d) a position-stabilized vehicle for suspending the radio-controlled parafoil device and the intercept device at a stable location above the earth, prior to capture of the cruise missile by the intercept device.

3. A cruise missile recovery system for capturing a flying cruise missile and for guiding the cruise missile to a land spot, comprising:

(a) an intercept device for capturing the flying cruise missile;

(b) a radio-controlled parafoil connected to the intercept device for allowing the intercept device and cruise missile to be guided to the landing spot during descent of the intercept device and cruise missile, after capture of the flying cruise missile by the intercept device;

(c) a drogue parachute connected to the radio-controlled parafoil for aiding in deployment of the radio-controlled parafoil;

(d) a position-stabilized vehicle for suspending the radio-controlled parafoil device and the intercept device at a stable location above the earth, prior to capture of the cruise missile by the intercept device; and (e) a tension release coupling for releasably coupling the position-stabilized vehicle to the radio-controlled parafoil prior to capture of the flying cruise missile by the intercept device.

* * * * *